US011738568B1

(12) United States Patent
Yuruzume

(10) Patent No.: US 11,738,568 B1
(45) Date of Patent: Aug. 29, 2023

(54) PRINTER

(71) Applicant: TOSHIBA TEC KABUSHIKI KAISHA, Tokyo (JP)

(72) Inventor: Satoshi Yuruzume, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/668,424

(22) Filed: Feb. 10, 2022

(51) Int. Cl.
*B41J 29/38* (2006.01)
*B41J 2/335* (2006.01)

(52) U.S. Cl.
CPC ..... *B41J 2/3352* (2013.01); *B41J 29/38* (2013.01)

(58) Field of Classification Search
CPC ..... B41J 2/3352; B41J 29/38
See application file for complete search history.

(56) References Cited

U.S. PATENT DOCUMENTS

2016/0136981 A1* 5/2016 Suzuki ..... B65H 23/188 226/195
2019/0100400 A1* 4/2019 Inoue ..... B65H 16/103
2019/0287431 A1 9/2019 Yamada

FOREIGN PATENT DOCUMENTS

JP H07117919 A * 5/1995 ..... B65H 26/08
JP 2005-059233 3/2005
JP 2007-052353 3/2007
JP 2013-136160 7/2013
WO WO-2017203220 A1 * 11/2017 ..... F16B 31/02

* cited by examiner

*Primary Examiner* — Yaovi M Ameh
(74) *Attorney, Agent, or Firm* — Amin, Turocy & Watson, LLP

(57) ABSTRACT

According to one embodiment, a printer includes an input interface and a processor. The input interface inputs a distance signal output from a distance sensor opposite to a rotating surface of a roll around which a sheet material is wound in a roll shape. The processor detects an amount of change in a distance from the distance sensor to the rotating surface of the roll based on a plurality of distance signals input at different timings, detects a vibration convergence state of the roll from the amount of change in the distance, and detects a diameter of the roll based on the distance signal input in the vibration convergence state.

18 Claims, 7 Drawing Sheets

PRINTER

FIELD

Embodiments described herein relate generally to a printer and printing method.

BACKGROUND

A barcode printer that prints a barcode on a label is known. The barcode printer stores a roll around which a sheet material is wound in a roll shape, pulls out the sheet from the roll, and prints the barcode and the like on the label on the sheet pulled out therefrom.

Known is a technique in which the barcode printer includes a distance sensor that detects a distance up to an outer surface of the roll, and detects the remaining number of labels provided in the roll from the detected distance. Also, known is a technique in which the barcode printer includes a dump mechanism in a roll conveyance path to implement stable sheet conveyance.

DETAILED DESCRIPTION

In general, according to one embodiment, a printer includes an input interface and a processor. The input interface inputs a distance signal output from a distance sensor opposite to a rotating surface of a roll around which a sheet material is wound in a roll shape. The processor detects an amount of change in a distance from the distance sensor to the rotating surface of the roll based on a plurality of distance signals input at different timings, detects a vibration convergence state of the roll from the amount of change in the distance, and detects a diameter of the roll based on the distance signal input in the vibration convergence state.

Hereinafter, a printer 100 of an embodiment will be described with reference to the drawings.

Figure 1:
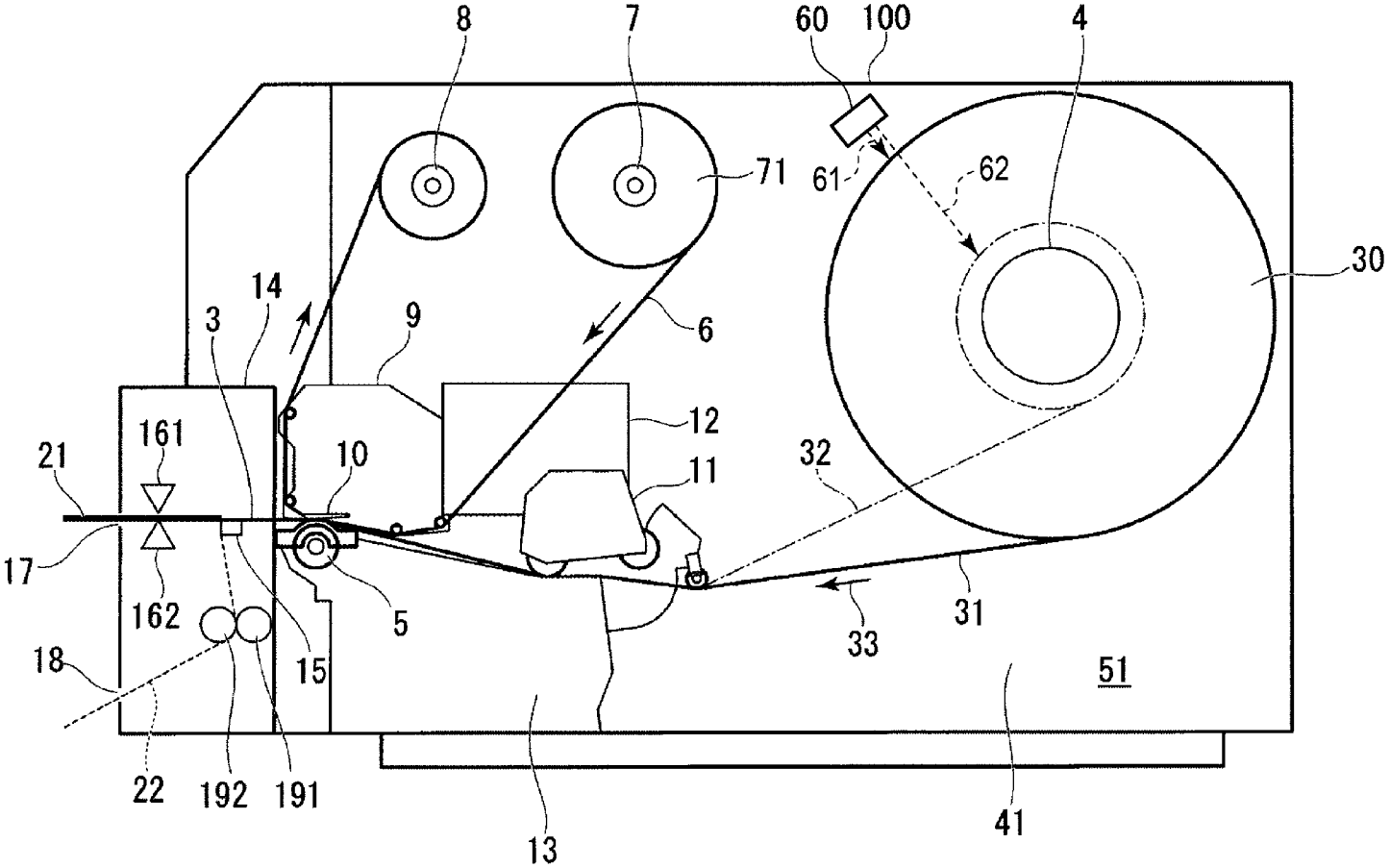
FIG. 1 is a side view from a first direction illustrating an example of an internal configuration of a printer of an embodiment.
Figure 2:
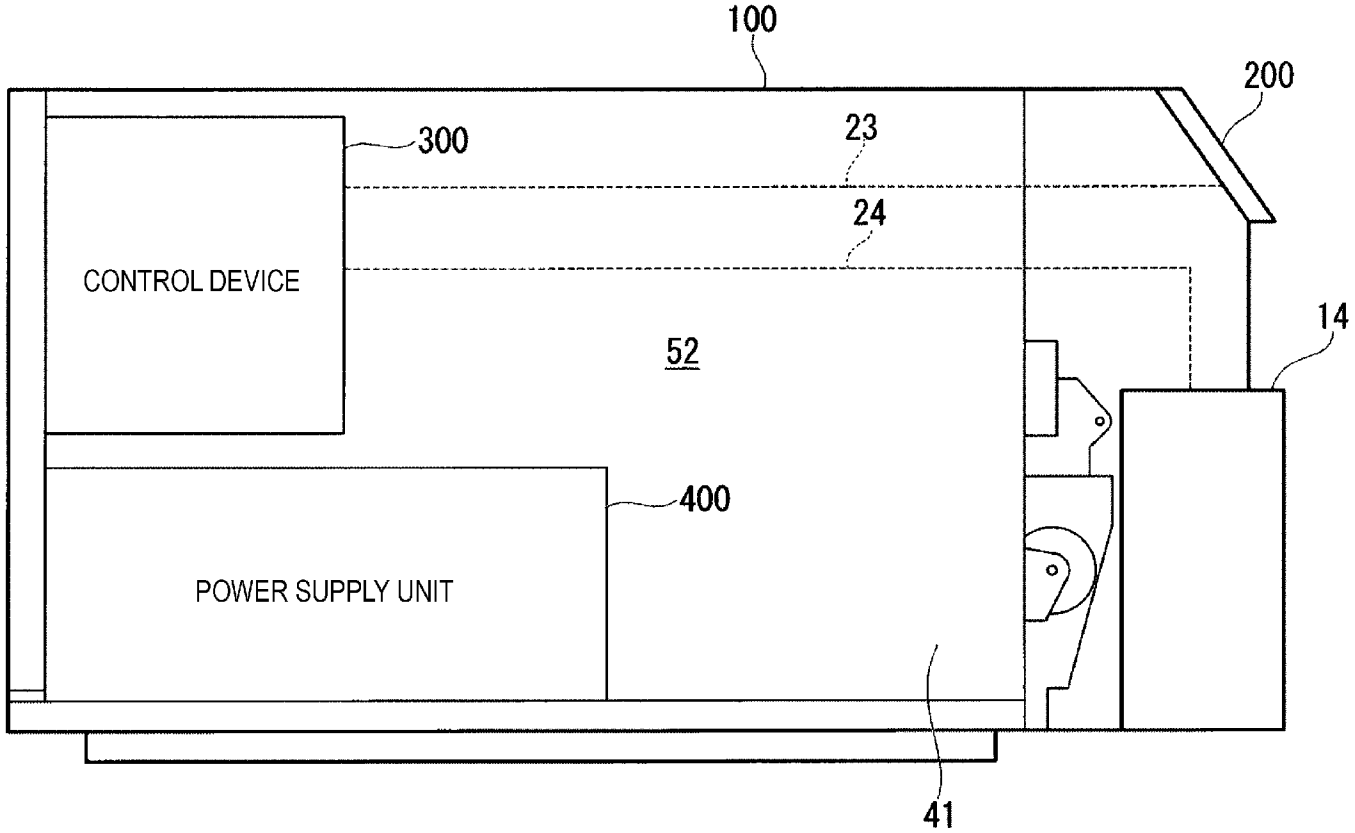
FIG. 2 is a side view from a second direction illustrating an example of the internal configuration.

FIGS. 1 and 2 are side views illustrating an example of an internal configuration of the printer 100 of the embodiment. FIGS. 1 and 2 show views of the internal configuration of the printer 100 when viewed from different sides. As illustrated in FIGS. 1 and 2, the printer 100 includes a first chamber 51 and a second chamber 52 in a housing. The first chamber 51 and the second chamber 52 are separated from each other by a vertical wall 41. First, a configuration in the first chamber 51 will be described with reference to FIG. 1.

The printer 100 includes a roll 30 around which a sheet material 31 (hereinafter referred to as a sheet 31) is wound in a roll shape. For example, the sheet 31 is a label paper having a configuration in which a plurality of labels are attached to a belt-shaped mount. The printer 100 pulls out the sheet 31 from the roll 30 and prints desired information such as a barcode and the like on the label of the sheet 31 pulled out therefrom.

FIG. 1 illustrates an example of an inwardly wound roll around which the sheet 31 is wound in a state where the label becomes an inside of the mount. The sheet 31 illustrated with a solid line in FIG. 1 corresponds to a sheet pulled out from the roll 30 in a state where a diameter of the roll 30 is relatively large. On the other hand, a sheet 32 illustrated with an alternate long and short dash line in FIG. 1 corresponds to a sheet pulled out from the roll 30 in a state where the diameter of the roll 30 is relatively small. An arrow 33 illustrated in FIG. 1 indicates a feeding direction of the sheet 31.

The printer 100 includes a distance sensor 60. The distance sensor 60 is provided to be opposite to a rotating surface of the roll 30. The distance sensor 60 includes a light emitting unit that emits light and a light receiving unit that receives reflected light of the emitted light, and outputs a distance signal indicating a distance from the light receiving unit to the rotating surface of the roll 30. In the roll 30, the diameter of the roll 30 becomes smaller as the sheet 31 is pulled out therefrom. The distance from the distance sensor 60 to the rotating surface of the roll 30 increases as the diameter of the roll 30 becomes smaller.

As illustrated in FIG. 1, in the first chamber 51, a roll holding shaft 4, a platen roller 5, a supply shaft 7 of an ink ribbon 6, a winding shaft 8 of the ink ribbon 6, a head block 9, a thermal head 10, and a roller block 11 are mounted in a posture approximately perpendicular to the vertical wall 41. The head block 9 and the roller block 11 are integrated to form a movable block 12 as a movable unit.

The first chamber 51 includes a fixed block 13 including the platen roller 5. The movable block 12 and the fixed block 13 are installed to be opposite to each other. A conveyance path 3 for conveying the sheet 31 is provided between the movable block 12 and the fixed block 13.

The roll holding shaft 4 pulls out the sheet 31 from the roll 30 and holds the sheet 31 so as to be conveyed. Specifically, the roll holding shaft 4 holds the roll 30 so that the roll 30 can rotate around an axis perpendicular to the vertical wall 41. The roll holding shaft 4 and the roll 30 are not driven by a motor and the like. In the roll holding shaft 4 and the roll 30, the sheet 31 is pulled out from the roll 30 by the rotation of the platen roller 5 by power from the motor, and the roll 30 rotates.

The platen roller 5 is rotationally driven by a rotation drive mechanism including a motor such as a stepping motor and the like, a gear, a belt, and the like, and pulls out the sheet 31 from the roll 30. The platen roller 5 is disposed to be opposite to the thermal head 10. The sheet 31 pulled out from the roll 30 is pressed against the platen roller 5 by the thermal head 10 energized by an elastic member. By such a structure, the platen roller 5 and the thermal head 10 sandwich the sheet 31 pulled out from the roll 30. Next, the platen roller 5 driven by the rotation drive mechanism pulls out the sheet 31 held by the roll holding shaft 4 and conveys the sheet 31 to the conveyance path 3. In the following description, the feeding direction is described as a forward rotation direction, and a direction opposite to the feeding direction is described as a reverse rotation direction.

A roll unit 71 of the ink ribbon 6 (hereinafter, referred to as a "ribbon roll") is set on the supply shaft 7 of the ink ribbon 6. The winding shaft 8 is rotationally driven by a rotation drive mechanism including a motor, a gear, a belt, and the like. By the rotation of the winding shaft 8, the ink ribbon 6 is wound around the winding shaft 8 and pulled out from the ribbon roll 71. The ink ribbon 6 and the sheet 31 are sandwiched between the thermal head 10 and the platen roller 5.

The thermal head 10 is disposed above the platen roller 5 and is disposed to be opposite to the platen roller 5. The thermal head 10 performs printing on the label attached to the mount of the sheet 31 pulled out by the platen roller 5. The thermal head 10 is provided to be able to contact the platen roller 5 and to be separated therefrom, and is energized toward the platen roller 5 by an elastic member. The thermal head 10 energized by the elastic member presses the sheet 31 conveyed between the thermal head 10 and the platen roller 5 against the platen roller 5.

The thermal head 10 includes a plurality of heat generating elements arranged in a row, and the heat generating elements are heated by selectively energizing the plurality of heat generating elements. The thermal head 10 melts or sublimates ink of the ink ribbon 6 by the heat generated from the heat generating element, and transfers the ink to the label attached to the mount of the sheet 31, thereby performing printing. In the following description, a mechanism configured with the platen roller 5, the ink ribbon 6, the supply shaft 7, the winding shaft 8, the rotation drive mechanism, the thermal head 10, and a motor controller will be referred to as a printing mechanism.

The peeling unit 14 is mounted on the printer 100. The peeling unit 14 is a device that peels the label from the sheet 31 conveyed through the conveyance path 3. The peeling unit 14 includes a peeling bar 15, a sensor 161, a sensor 162, a first discharge port 17, a second discharge port 18, a feed roller 191 (a second conveyance unit) , and a pinch roller 192.

The peeling bar 15 has a flat plate shape and is provided in front of the printing mechanism, that is, provided on a front side in the feeding direction of the sheet 31 (the forward rotation direction).

The sensor 161 is an emitting unit that emits light. The sensor 162 is a light receiving unit that receives the light emitted from the sensor 161. The sensor 162 detects a voltage level corresponding to an amount of the received light.

The sensor 161 and the sensor 162 are used to detect presence or absence of a peeled label 21. In the following description, the sensor 161 and the sensor 162 will be referred to as a sensor 16 if there is no particular distinction therebetween. In the embodiment, the sensor 16 is a transmission type sensor and may be a reflection type sensor.

The first discharge port 17 is a discharge port from which the peeled label 21 is discharged. The second discharge port 18 is a discharge port from which the mount 22 whose label is peeled off by the peeling bar 15 (hereinafter referred to as a "peeled mount") is discharged.

The feed roller 191 is rotationally driven by a rotation drive mechanism including a motor such as a stepping motor and the like, a gear, a belt, and the like. The feed roller 191 is disposed to be opposite to the pinch roller 192. The peeled mount 22 is sandwiched between the feed roller 191 and the pinch roller 192 by such a structure. Next, the feed roller 191 driven by the rotation drive mechanism pulls out the peeled mount 22 and conveys the peeled mount 22 to the second discharge port 18.

Next, a configuration in the second chamber 52 will be described with reference to FIG. 2. As illustrated in FIG. 2, a control device 300 and a power supply unit 400 are housed in the second chamber 52.

The control device 300 controls an overall operation of the printer 100. For example, the control device 300 controls the conveyance of the sheet 31 by controlling the platen roller 5 and the feed roller 191. For example, the control device 300 rotates the platen roller 5 and the feed roller 191 in the feeding direction (the forward rotation direction) during printing. For example, the control device 300 rotates the platen roller 5 and the feed roller 191 in the direction opposite to the feeding direction (the reverse rotation direction) during back feeding.

The control device 300 controls the printing mechanism to print data to be printed (hereinafter, referred to as "print data") on the label. Normally, the control device 300 performs control so that a conveyance speed of the feed roller 191 is faster than a conveyance speed of the platen roller 5 during the printing and back feeding. The motor and the rotation drive mechanism are provided in the second chamber 52.

The power supply unit 400 supplies power to the printer 100. A broken line 23 represents a path through which data passes between a display unit 200 and the control device 300 provided in the printer 100. A broken line 24 represents a path through which data passes between the control device 300 and the peeling unit 14.

The display unit 200 is an image display device such as a liquid crystal display, an organic electro luminescence (EL) display, and the like. The display unit 200 operates as an output user interface and displays a character and an image. The display unit 200 operates as an input user interface and receives an input of an instruction from a user. The instruction input to the display unit 200 is notified to the control device 300. For example, the display unit 200 outputs information on the diameter of the roll 30 or information on the label on the sheet 31 during the period when the sheet 31 is pulled out.

Next, an outline of the operation of the printer 100 in the embodiment will be described.

If the label on which the print data is printed is conveyed to a stop location, the printer 100 controls the platen roller 5 and the feed roller 191 to stop the conveyance of the label. The stop location is a predetermined location, and is, for example, a location where a rear end portion of the peeled label remains on the peeling bar 15. At this time, when the printer 100 stops the feed roller 191 and a predetermined time passes, the printer 100 stops the platen roller 5. Accordingly, the sheet 31 on the peeling bar 15 can be loosened. This process is performed under the control of the control device 300.

Figure 3:
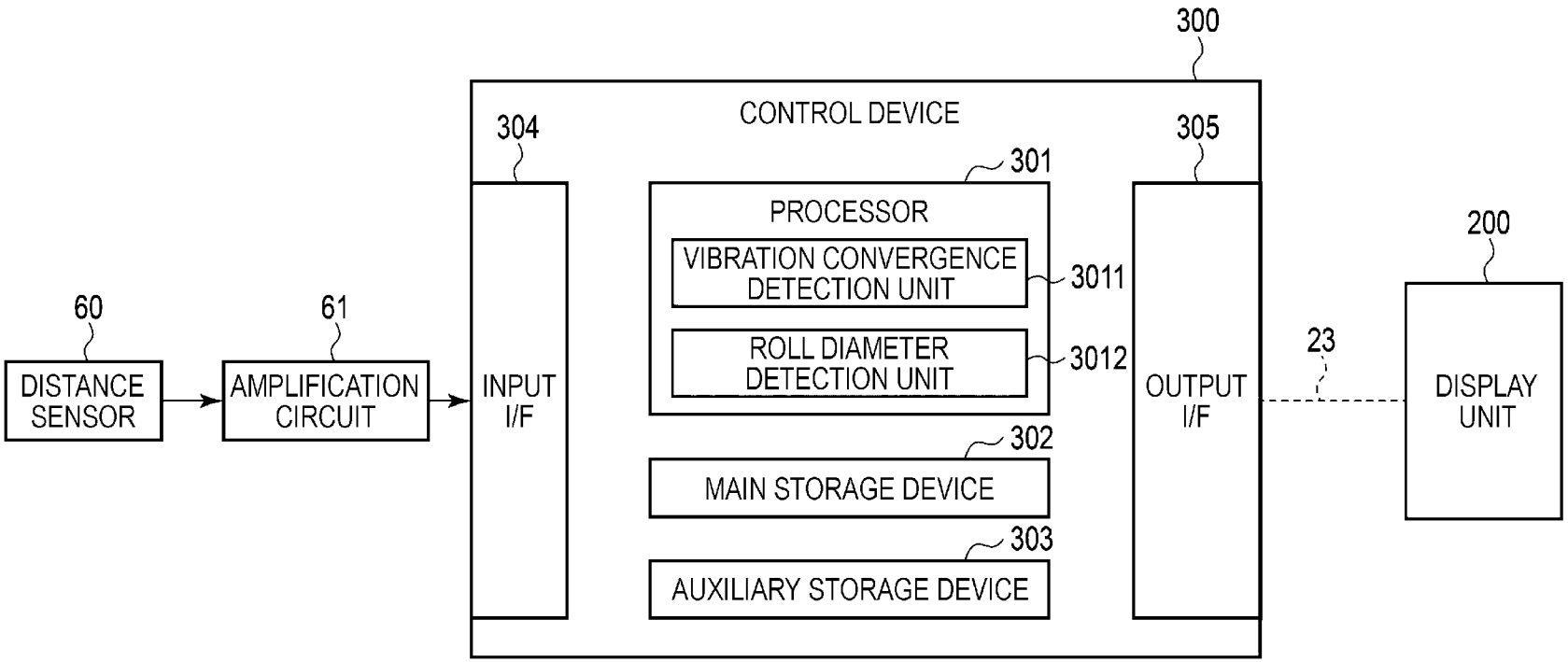
FIG. 3 is a block diagram illustrating an example of an internal configuration of a control device.

FIG. 3 is a block diagram illustrating an example of an internal configuration of the control device 300 of the printer 100 of the embodiment.

As illustrated in FIG. 3, the printer 100 includes a distance sensor 60, an amplification circuit 61, the control device 300, the display unit 200, and the like.

The amplification circuit 61 amplifies the distance signal from the distance sensor 60, and inputs the amplified distance signal to the control device 300. Even though an output of the distance signal from the distance sensor 60 decreases according to the distance from the distance sensor 60, the output of the distance signal is amplified by the amplification circuit 61, such that the distance signal having an output sufficient for distance detection is input to the control device 300.

The control device 300 includes a processor 301, a main storage device 302, an auxiliary storage device 303, an input interface (an input I/F) 304, and an output interface (an output I/F) 305.

The input interface 304 is output from the distance sensor 60 and inputs the distance signal amplified by the amplification circuit 61 to the processor 301. The output interface 305 outputs display information such as warning information and the like to the display unit 200 and the like.

The processor 301 is a central processing unit (CPU) and the like. The processor 301 includes a vibration convergence detection unit 3011 and a roll diameter detection unit 3012, and implements functions of the vibration convergence detection unit 3011 and the roll diameter detection unit 3012 by executing a program stored in the auxiliary storage device 303 and the like. The vibration convergence detection unit 3011 and the roll diameter detection unit 3012 may be implemented by hardware such as large scale integration (LSI), an application specific integrated circuit (ASIC), a field-programmable gate array (FPGA), and the like having the same function as that of the processor 301 executing the program.

The vibration convergence detection unit 3011 detects an amount of change in the distance from the distance sensor 60 to the rotating surface of the roll 30 based on a plurality of distance signals input at different timings, and detects a vibration convergence state of the roll from the amount of change in the distance. For example, the vibration convergence detection unit 3011 detects the vibration convergence state from decreasing tendency of difference values of the plurality of distance signals. The vibration convergence detection unit 3011 detects the amount of change from a difference value between a distance signal Vx input at time tx and a distance signal Vx+1 input at time tx+1 in a predetermined cycle (for example, a fixed cycle T), and detects a period during which the amount of change falls within a fixed range as the vibration convergence state.

The distance from the distance sensor 60 to the rotating surface of the roll 30 increases as the diameter of the roll 30 becomes smaller, such that an output voltage of the distance signal gradually decreases. Therefore, the vibration convergence detection unit 3011 detects whether or not the amount of change in the distance falls within the fixed range based on a value at which the output voltage of the distance signal gradually decreases.

The roll diameter detection unit 3012 selects the distance signal input in the vibration convergence state detected by the vibration convergence detection unit 3011, and detects the diameter of the roll 30 based on the selected distance signal.

The main storage device 302 is a memory used for reading and writing data. The main storage device 302 is used as a so-called work area and the like for storing data to be temporarily used if the processor 301 performs various processes.

The auxiliary storage device 303 is a non-temporary computer-readable storage medium and stores the program. The auxiliary storage device 303 stores data or various set values and the like to be used if the processor 301 performs various processes. The printer 100 may be transferred in a state where the program is stored in the auxiliary storage device 303, or the printer 100 may be transferred in a state where the program is not stored therein. In the latter case, the printer 100 reads the program stored in a removable storage medium such as an optical disk or a semiconductor memory, and writes the read program to the auxiliary storage device 303. Alternatively, the printer 100 downloads the program via a telecommunication line and the like, and writes the downloaded program to the auxiliary storage device 303.

The auxiliary storage device 303 stores a voltage value corresponding to a distance signal input in a predetermined cycle. The auxiliary storage device 303 stores a threshold value Tha (a first threshold value) for evaluating a difference value between two distance signals input at different timings. The auxiliary storage device 303 stores a count value in which the difference value therebetween is less than the threshold value Tha, and further stores a threshold value Thb (a second threshold value) for evaluating this count value. The auxiliary storage device 303 further stores a threshold value Thc (a third threshold value) for evaluating the diameter of the roll 30 in variable control of the cycle for inputting the distance signal. The auxiliary storage device 303 further stores a threshold value Thd (a fourth threshold value) for evaluating the diameter of the roll 30 in the output determination of warning information.

The auxiliary storage device 303 stores the fixed cycle T serving as a reference for inputting the distance signal, and further stores cycles T1 and T2 selected by the variable control.

Figure 4:
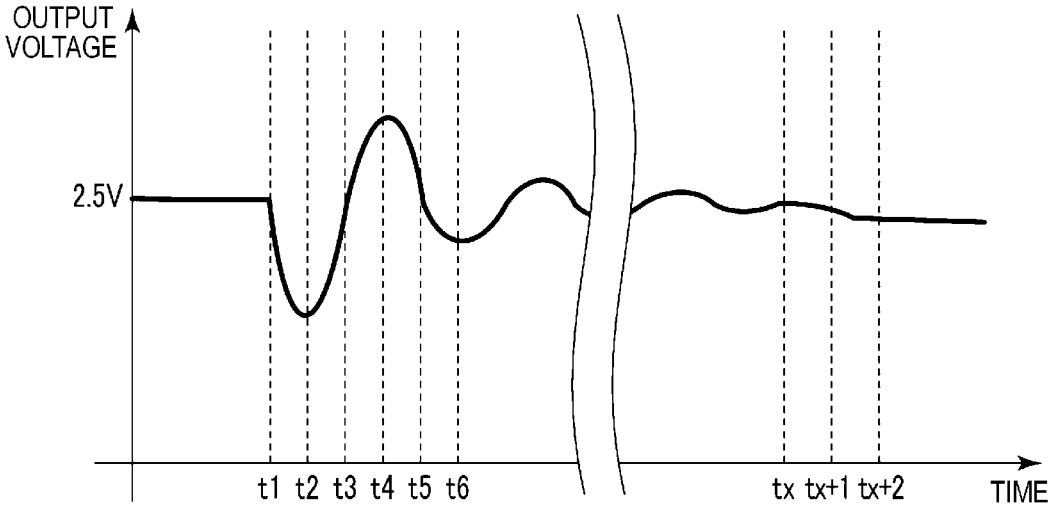
FIG. 4 is a diagram illustrating an example of an output waveform from a distance sensor.

FIG. 4 is a diagram illustrating an example of an output waveform from the distance sensor 60 of the printer 100 according to the embodiment.

The distance sensor 60 outputs a distance signal indicating a distance up to the rotating surface of the roll 30. The diameter of the roll 30 becomes smaller as the sheet 31 is pulled out from the roll 30. The distance from the distance sensor 60 to the rotating surface of the roll 30 increases as the diameter of the roll 30 becomes smaller, and the output voltage of the distance signal gradually decreases. For example, from time t1 to time tx+2, the voltage value of the distance signal gradually decreases.

Immediately after the platen roller 5 rotates and the sheet 31 starts to be pulled out from the roll 30 (from time t1 to time t6), a pull-out speed of the sheet 31 is accelerated, and the roll 30 to which a force is applied significantly vibrates. In response thereto, the voltage value of the distance signal significantly vibrates up and down. With the lapse of time, the pull-out speed of the sheet 31 becomes constant (from time tx to time tx+2), the vibration of the roll 30 becomes small, and vertical vibration of the voltage value of the distance signal also becomes small.

That is, from time t1 to time tx+2, the voltage value of the distance signal significantly vibrates up and down at first, and the vertical vibration thereof gradually becomes small, such that the voltage value thereof gradually decreases during that time.

Figure 5:
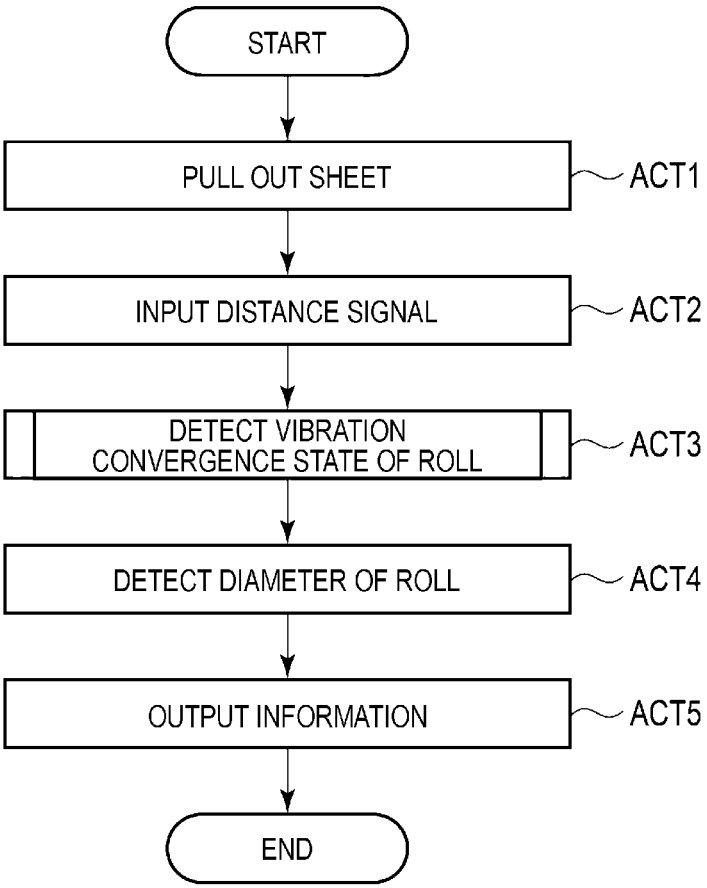
FIG. 5 is a flowchart illustrating an example of a roll diameter detection process.

FIG. 5 is a flowchart showing an example of a roll diameter detection process by the printer 100 according to the embodiment.

For example, the display unit 200 receives an input of a printing instruction, and the processor 301 executes printing by the printing mechanism based on the printing instruction. In response to the execution of printing, the platen roller 5 is rotated by the rotation drive mechanism, the sheet 31 is pulled out from the roll 30 (ACT 1), and the sheet 31 pulled out is conveyed via the conveyance path 3.

The distance sensor 60 outputs a distance signal, and the amplification circuit 61 amplifies the distance signal. The input interface 304 inputs the amplified distance signal to the processor 301 in the fixed cycle T (ACT 2).

The processor 301 (the vibration convergence detection unit 3011) acquires the distance signal for each cycle T, and records acquisition time and the distance signal in the auxiliary storage device 303. The processor 301 detects an amount of change in a distance from the distance sensor 60 to the rotating surface of the roll 30 based on a plurality of distance signals input at different timings, and detects a vibration convergence state of the roll 30 from the amount of change in the distance (ACT 3). For example, the processor 301 detects the vibration convergence state from decreasing tendency of a difference value of the plurality of distance signals (ACT 3).

The processor 301 (the roll diameter detection unit 3012) detects the diameter of the roll 30 based on the distance signal input during a period corresponding to the vibration convergence state (ACT 4).

Immediately after the platen roller 5 rotates and the sheet 31 starts to be pulled out from the roll 30 (for example, from time t1 to time t6), the pull-out speed of the sheet 31 is accelerated, and the roll 30 to which a force is applied significantly vibrates. In response thereto, an output signal of the distance sensor 60 significantly vibrates up and down. With the lapse of time, the pull-out speed of the sheet 31 becomes constant (from time tx to time tx+2), the vibration of the roll 30 becomes small, and vertical vibration of the output signal also becomes small.

The processor 301 detects the vibration convergence state in which the vertical vibration of the output signal becomes small, and detects the diameter of the roll 30 based on the distance signal input during the period corresponding to the vibration convergence state. Therefore, the diameter of the roll 30 can be accurately detected even during the period when the sheet 31 is pulled out from the roll 30.

The processor 301 inputs an instruction for outputting information based on a detection result of the diameter of the roll 30 during the period when the sheet 31 is pulled out from the roll 30 (ACT 5). Alternatively, if the diameter of the roll 30 becomes less than the threshold value Thd during the period when the sheet 31 is pulled out from the roll 30, the processor 301 inputs an instruction for outputting warning information such as near-end and the like (ACT 5).

The display unit 200 displays, numerically or with an image, information on the diameter of the roll 30, which decreases as the sheet 31 is pulled out from the roll 30, information on the rest of the sheet 31, or information on the rest of the label on the sheet 31 based on the instruction from the processor 301 during the period when the sheet 31 is pulled out from the roll 30.

Figure 6:
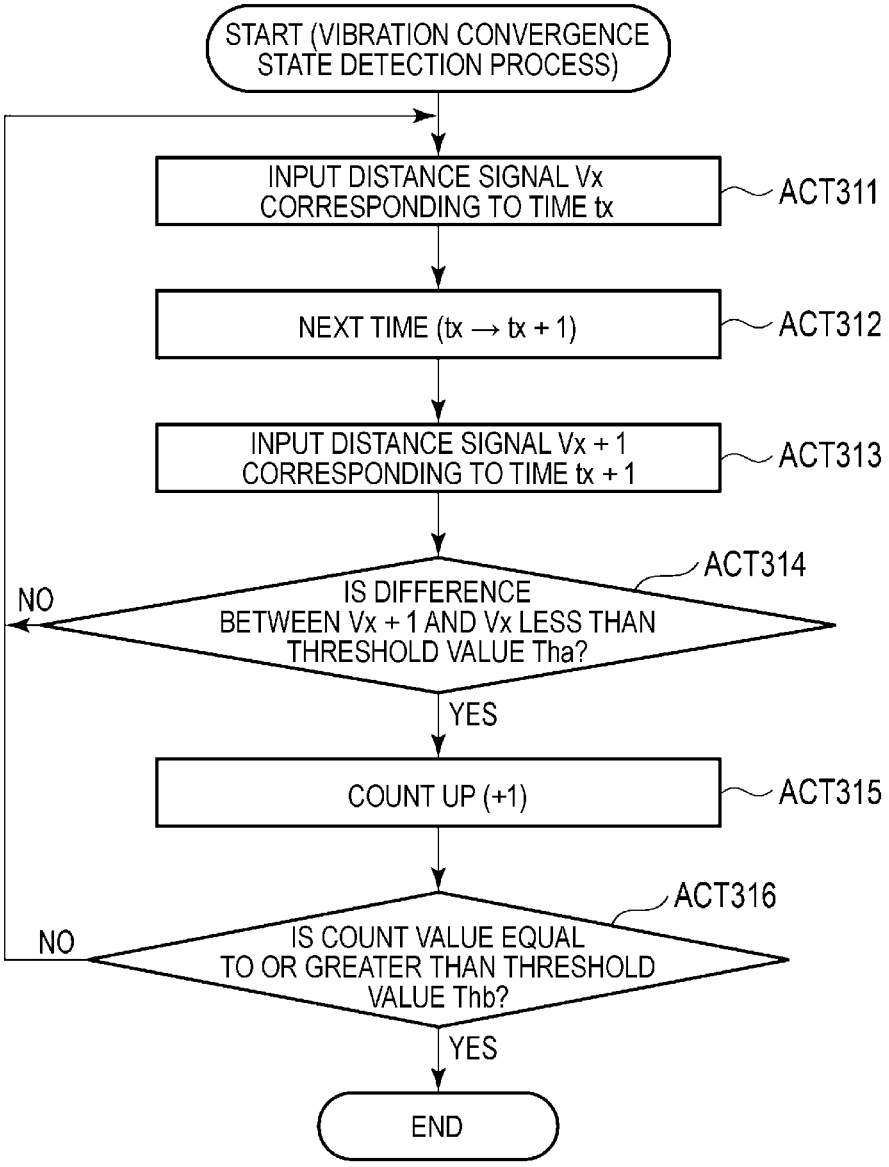
FIG. 6 is a flowchart illustrating an example of a vibration convergence state detection process.

FIG. 6 is a flowchart showing an example of a vibration convergence state detection process (ACT 3) by the printer 100 according to the embodiment.

The processor 301 (the vibration convergence detection unit 3011) sets a predetermined cycle. The input interface 304 inputs a distance signal Vx corresponding to time tx in the predetermined cycle (ACT 311). At the next time (tx→tx+1) (ACT 312), the input interface 304 inputs a distance signal Vx+1 corresponding to time tx+1 in the predetermined cycle (ACT 313).

The processor 301 compares the distance signal Vx+1 with the distance signal Vx, and if a difference value between the distance signal Vx+1 and the distance signal Vx is less than the threshold value Tha (ACT 314, YES), the processor 301 counts up (+1) the counter (ACT 315). If the difference value therebetween is equal to or greater than the threshold value Tha (ACT 314, NO), the processor 301 transitions to the process of ACT 311.

If the number of times the difference value therebetween becomes less than the threshold value Tha (the count value) is less than the threshold value Thb (ACT 316, NO), the processor 301 transitions to the process of ACT 311. The processor 301 detects the vibration convergence state of the roll 30 if the number of times the difference value therebetween becomes less than the threshold value Tha is equal to or greater than the threshold value Thb (ACT 316, YES).

The vibration convergence state may be estimated by paying attention to a point indicating that a vibration width of the roll 30 varies depending on the pull-out speed of the sheet 31. The processor 301 detects the pull-out speed of the sheet 31 from a rotation drive of the platen roller 5, and detects an acceleration period and a constant speed period from an amount of change in the pull-out speed. During the acceleration period, the vibration of the roll 30 is likely to be large, and during the constant speed period, the vibration of the roll 30 is likely to be small. For example, the processor 301 may detect the constant speed period as the vibration convergence state of the roll 30.

Figure 7:
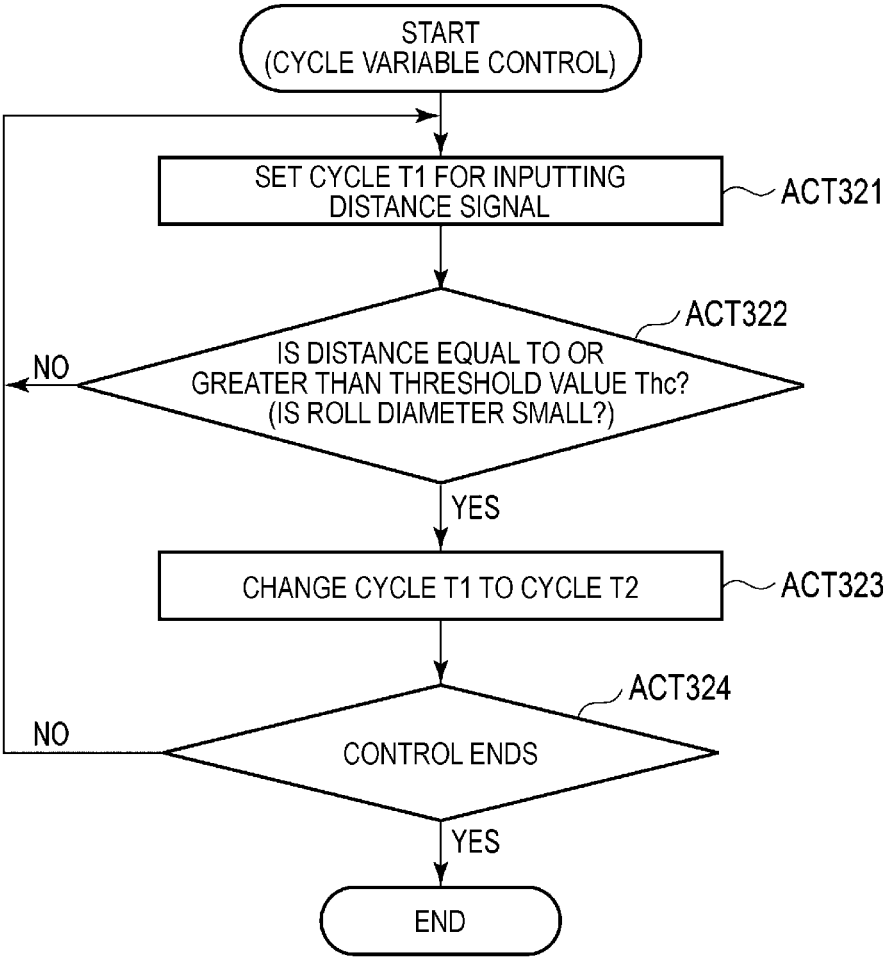
FIG. 7 is a flowchart illustrating an example of cycle variable control.

FIG. 7 is a flowchart illustrating an example of cycle variable control by the printer 100 according to the embodiment. The processor 301 executes the cycle variable control in the vibration convergence state detection process (ACT 3), and the input interface 304 inputs a distance signal in a variable cycle corresponding to a distance indicated by the distance signal.

As illustrated in FIG. 7, the processor 301 (the vibration convergence detection unit 3011) sets a cycle T1 (a first cycle) for inputting the distance signal (ACT 321). The input interface 304 inputs the distance signal to the processor 301 in the cycle T1.

If the processor 301 compares the distance indicated by the distance signal with the threshold value Thc, the diameter of the roll 30 is large, and the distance less than the threshold value Thc (a first distance) is detected (ACT 322, NO), the processor 301 transitions to the process of ACT 321 and sets the cycle T1. The input interface 304 inputs the distance signal to the processor 301 in the cycle T1.

If the diameter of the roll 30 becomes smaller and the processor 301 detects the distance equal to or greater than the threshold value Thc (a second distance) (ACT 322, YES), the processor 301 changes the cycle T1 to a cycle T2 (a second cycle) (ACT 323). The input interface 304 inputs the distance signal to the processor 301 in the cycle T2.

When continuously performing the variable control (ACT 324, NO), the processor 301 repeatedly performs the processes from ACT 321 to ACT 323.

For example, the cycle T2 is a cycle shorter than the cycle T1. The vibration generated in the roll 30 varies depending on a size of the diameter of the roll 30. If the diameter of the roll 30 is large, the vibration is also likely to be large, and if the diameter thereof is small, the vibration is also likely to be small. In order to accurately obtain the vibration that varies depending on the size of the diameter thereof, if the diameter of the roll 30 is large and the distance is less than the threshold value Thc, the processor 301 sets the cycle T1. If the diameter of the roll 30 is small and the distance is equal to or greater than the threshold value Thc, the processor 301 sets the cycle T2.

The processor 301 may set a predetermined period, and the input interface 304 may input the distance signal in the cycle T1 or the cycle T2 during the predetermined period. For example, if the diameter of the roll 30 is large, the cycle T1 is set, and N1 pieces of distance signals are input in the cycle T1 during the predetermined period. If the diameter of the roll 30 is small, the cycle T2 is set, and N2 (N2>N1) pieces of distance signals are input in the cycle T2 during the predetermined period. If the diameter of the roll 30 is large, the vibration of the roll 30 is likely to be large, and even though the number of input distance signals is reduced, the amount of change in the distance signal can be obtained. If the diameter of the roll 30 is small, the vibration of the roll 30 is likely to be small, and the amount of change in the distance signal can be obtained by increasing the number of samples of the input distance signal.

As described above, the embodiment describes a case in which the cycle is variably controlled according to the size of the diameter of the roll 30, and the processor 301 may variably control the period during which the distance signal is acquired according to the size of the diameter of the roll 30. For example, if the diameter of the roll 30 is large and the distance is less than the threshold value Thc, the input interface 304 inputs N1 pieces of distance signals in the cycle T during a period L1 set by the processor 301. If the diameter of the roll 30 is small and the distance is equal to or greater than the threshold value Thc, the input interface 304 inputs N2 pieces of (N2>N1) distance signals in the cycle T during a period L2 longer than the period L1 set by the processor 301.

Alternatively, the processor 301 may variably control the cycle according to the pull-out speed of the sheet 31. During the acceleration period, the vibration of the roll 30 is likely to be large, and during the constant speed period, the vibration of the roll 30 is likely to be small. The processor 301 sets the cycle T1 during the acceleration period in order to accurately obtain the vibration that varies depending on the pull-out speed of the sheet 31. During the constant speed period, the processor 301 sets the cycle T2.

Even during the period when the sheet 31 is pulled out from the roll 30, the printer 100 of the embodiment can detect the diameter of the roll 30 with high accuracy based on the distance signal input in the vibration convergence state. Accordingly, it is possible to display, numerically or with an image, the information on the diameter of the roll 30, which decreases as the sheet 31 is pulled out from the roll 30, the information on the rest of the sheet 31, or the information on the rest of the label on the sheet 31.

The printer 100 can also detect the diameter of the roll 30 with high accuracy based on the distance signal input in the variable cycle (the cycle T1 or T2) according to the diameter of the roll 30. The printer 100 can also detect the diameter of the roll 30 with high accuracy based on the distance signal input in the variable period (the period L1 or L2) according to the diameter of the roll 30. The printer 100 can also detect the diameter of the roll 30 with high accuracy based on the distance signal input in the variable cycle (the cycle T1 or T2) according to the pull-out speed of the sheet 31.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer, comprising:

an input interface that receives a distance signal output from a distance sensor opposite to a rotating surface of a roll around which a sheet material is wound in a roll shape; and a processor that:

detects an amount of change in a distance from the distance sensor to the rotating surface of the roll based on a plurality of distance signals received at different times, detects a vibration convergence state of the roll from the amount of change in the distance, detects a diameter of the roll based on the distance signal received in the vibration convergence state, and sets a first cycle corresponding to detection of a first distance less than a first threshold value, and sets a second cycle shorter than the first cycle corresponding to detection of a second distance equal to or greater than the first threshold value, wherein the input interface receives the distance signal in the first cycle or the second cycle.

2. The printer according to claim 1, wherein the processor detects the vibration convergence state from decreasing tendency of a difference value of the plurality of distance signals.

3. The printer according to claim 1, wherein the processor detects the vibration convergence state if a number of times a difference value of two distance signals received at different times becomes less than a first threshold value is equal to or greater than a second threshold value.

4. The printer according to claim 1, wherein the input interface receives the distance signal in a fixed cycle.

5. The printer according to claim 1, wherein the input interface receives the distance signal in a variable cycle according to the distance.

6. The printer according to claim 1, wherein the input interface receives the distance signal in the first cycle or the second cycle during a predetermined period.

7. The printer according to claim 1, further comprising:

a user interface that outputs information on the diameter of the roll.

8. The printer according to claim 7, wherein the user interface outputs warning information if the diameter of the roll is less than a fourth threshold value.

9. The printer according to claim 7, further comprising:

a roller that pulls out the sheet material from the roll, wherein the user interface outputs information on the diameter of the roll during a period when the sheet material is pulled out therefrom.

10. A method for a printer, comprising:

receiving a distance signal output from a distance sensor opposite to a rotating surface of a roll around which a sheet material is wound in a roll shape;

detecting an amount of change in a distance from the distance sensor to the rotating surface of the roll based on a plurality of distance signals received at different times;

detecting a vibration convergence state of the roll from the amount of change in the distance;

detecting a diameter of the roll based on the distance signal received in the vibration convergence state;

setting a first cycle corresponding to detection of a first distance less than a first threshold value;

setting a second cycle shorter than the first cycle corresponding to detection of a second distance equal to or greater than the first threshold value; and receiving the distance signal in the first cycle or the second cycle.

11. The method according to claim 10, further comprising:

detecting the vibration convergence state from decreasing tendency of a difference value of the plurality of distance signals.

12. The method according to claim 10, further comprising:

detecting the vibration convergence state if a number of times a difference value of two distance signals received at different times becomes less than a first threshold value is equal to or greater than a second threshold value.

13. The method according to claim 10, further comprising:

receiving the distance signal in a fixed cycle.

14. The method according to claim 10, further comprising:

receiving the distance signal in a variable cycle according to the distance.

15. The method according to claim 10, further comprising:

receiving the distance signal in the first cycle or the second cycle during a predetermined period.

16. The method according to claim 10, further comprising:

outputting information on the diameter of the roll.

17. The method according to claim 16, further comprising:

outputting warning information if the diameter of the roll is less than a fourth threshold value.

18. A thermal printer, comprising:

a thermal printing head;

an input interface that receives a distance signal output from a distance sensor opposite to a rotating surface of a roll around which a sheet material is wound in a roll shape; and a processor that:

detects an amount of change in a distance from the distance sensor to the rotating surface of the roll based on a plurality of distance signals received at different times, detects a vibration convergence state of the roll from the amount of change in the distance, detects a diameter of the roll based on the distance signal received in the vibration convergence state, sets a first cycle corresponding to detection of a first distance less than a first threshold value, sets a second cycle shorter than the first cycle corresponding to detection of a second distance equal to or greater than the first threshold value, and receives the distance signal in the first cycle or the second cycle.

* * * * *